US005564972A

United States Patent [19]

Marvin et al.

[11] Patent Number: 5,564,972

[45] Date of Patent: Oct. 15, 1996

[54] OUTSIDE DIAMETER FINISHING TOOL

[75] Inventors: Robert Marvin, Palatine, Ill.; Malcolm Owen, San Antonio, Tex.; Donald Bouchard, Cary, Ill.

[73] Assignee: Engis Corporation, Wheeling, Ill.

[21] Appl. No.: 309,818

[22] Filed: Sep. 21, 1994

[51] Int. Cl.[6] ..... B24D 11/00

[52] U.S. Cl. ..... 451/526; 451/314

[58] Field of Search ..... 451/180, 314, 451/313, 324, 495, 527, 483, 319, 312, 552, 526

[56] References Cited

U.S. PATENT DOCUMENTS

| | | | |
|---|---|---|---|
| 2,173,555 | 9/1939 | Hipple | 451/180 |
| 2,427,849 | 9/1947 | Garwood | 451/180 |
| 2,713,339 | 7/1955 | Sayers | 451/180 |
| 2,806,334 | 9/1957 | Oshry et al. | 451/180 |
| 3,188,674 | 6/1965 | Hobbs | 451/180 |
| 3,296,747 | 1/1967 | Philippsen et al. . | |
| 3,915,671 | 10/1975 | Kagawa . | |
| 3,925,034 | 12/1975 | Anna et al. . | |
| 3,936,982 | 2/1976 | Crabtree | 451/552 |
| 4,001,982 | 1/1977 | Griffin et al. | 451/552 |
| 4,198,789 | 4/1980 | Wheeler . | |
| 4,330,963 | 5/1982 | Wada et al. . | |
| 4,547,998 | 10/1985 | Kajiyama . | |
| 4,617,766 | 10/1986 | Sekiya et al. . | |
| 4,815,507 | 3/1989 | O'Rourke | 451/180 |
| 4,993,191 | 2/1991 | Judge et al. . | |
| 5,095,663 | 3/1992 | Judge et al. . | |
| 5,382,189 | 1/1995 | Arendall | 451/319 |

*Primary Examiner*—D. S. Meislin
*Assistant Examiner*—Andrew Weinberg
*Attorney, Agent, or Firm*—Wallenstein & Wagner, Ltd.

[57] ABSTRACT

An outside diameter finishing tool (10) has an outer shell (16) and an inner annular abrasive layer (22) for precision finishing the outer surfaces of generally cylindrical workpieces. The inner layer (22) of the tool (10) is made of superabrasives and defines the cutting size of the tool (10). The inner layer (22) cuts simultaneously around the full periphery of a cylindrical workpiece rotated within the tool (10). A slot (14) is provided through the tool (10) to allow for radial adjustment of the cutting size of the tool (10).

22 Claims, 3 Drawing Sheets

OUTSIDE DIAMETER FINISHING TOOL

DESCRIPTION

1. Technical Field

The present invention generally relates to surface finishing tools used for precision finishing surfaces of workpieces and specifically to a tool for finishing the outside diameter of a generally cylindrical workpiece and a method of making the tool.

2. Background of the Invention

Many types of machinery components require precision surface finishes to operate satisfactorily. An example is when piston rods are required to precisely fit into bores for maximum machine performance.

For many years, the industry has concentrated on the precision finishing of bores by such methods as single-pass superabrasive bore finishing. This process consists of a pre-set, barrel shaped tool coated with a superabrasive such as diamond particles. The tool is passed once through a bored workpiece while either the tool, workpiece, or both, are rotating. The process is completed without having to simultaneously adjust the tool size. This feature, along with the slow wear characteristics of superabrasives, allows the single-pass process to maintain maximum control of the bore size. As a result, tolerances of bore sizes can now be held to within a fraction of a micron.

These advancements have prompted the need for similar tolerances to be met for the mating parts, such as piston rods, that must fit within these bores. Thus, finishing the outside diameter of cylindrical workpieces becomes increasingly important.

In the past, outside diameter finishing has been done by grinding or turning. Another method for finishing the outside diameters of cylindrical workpieces is by using an external lapping hand tool. The external lapping hand tool generally consists of a short cylindrical base having an opening through the base, the base having a handle connected at its periphery. This tool is utilized by first inserting a short external lap, generally a hollow cylindrical part, into the opening in the base of the tool. The external lap is manufactured slightly over-size to allow for clearance around the workpiece to be finished and can be tightened to the appropriate diameter by the external lapping hand tool. Then a loose abrasive, or lapping abrasive, is applied to the inside of the short external lap which is now tightly seated in the external lapping hand tool. The tool is slid over the cylindrical workpiece and moved back and forth along the length of the workpiece to finish the outside diameter of the workpiece. Using the external lapping hand tool, however, does not produce workpieces meeting similar tolerances achieved with bore finishing. Similar tolerances are lacking for the external lap size, because loose abrasives are used. This requires the lapping tool to be adjusted for each part that is finished. The present invention utilizes fixed abrasives requiring no adjustment from one part to the next. Thus, there is still a need for a tool that can meet more exacting standards.

One application of an outside diameter finishing tool is found in U.S. Pat. No. 4,330,963 which discloses an apparatus for finishing an outer peripheral surface of a piston ring. The apparatus utilizes a grinding sleeve having a plurality of grindstone elements. The grindstones each have identical centers of curvature of a desired diameter and are placed adjacent one another to form a circular grinding surface with a diameter substantially equal to that of the piston rings. The diameter of the circular grinding surface is adjustable by either pinion/scroll means or a wedge-shaped adjuster, both of which adjust the radial position of the grindstone elements. The tool geometry of this patent, the desired circular grinding surface, is dependent upon the proper fit of all of the abrasive elements. There is greater control of tool geometry with the tool of the present invention, however, because there is only one integral abrasive element, the size of which is set at the initial stage of the manufacturing process of the tool. The desired tool geometry does not depend on the proper fit of individual elements.

The present invention utilizes an electroforming process to produce a tool having an abrasive surface which finishes the outside diameter of a workpiece. U.S. Pat. No. 4,617,766 discloses a method of forming a thin grindstone by electroplating abrasive grains onto a cathode plate having a pattern of the grindstone to be produced. The thin grindstone is removed from the cathode plate and secured to an inverted cup by an adhesive to form a grinding wheel for finishing flat plates. In another embodiment of the invention, the abrasive grains are electroformed directly onto an angled end flange of the inverted cup. The angled end flange acts as a mold and is thus dimensioned according to the required dimensions of the grindstone for its particular application. A portion of the angled end flange is then removed to expose a newly formed abrasive layer. The tool in this application, however, can only be used for workpieces having flat surfaces rather than the cylindrical workpieces that the tool of the present invention can finish.

None of the prior art devices for finishing the outside diameters of cylindrical workpieces have been able to achieve similar tolerances of a fraction of a micron which have been met for bore finishing. Through the use of superabrasives and a unique manufacturing process which achieves maximum control over tool sizing, the outside diameter finishing tool can finish cylindrical workpieces relatively economically to dimensions having similar stringent tolerances as set by bore finishing.

SUMMARY OF THE INVENTION

The present invention relates to an outside diameter finishing tool for precision finishing the outer surfaces of generally cylindrical workpieces. It is an object of the present invention to provide an outside diameter finishing tool using superabrasives to cut simultaneously around the full periphery of a generally cylindrical workpiece while the workpiece or tool freely passes through or over the other. It is also an object of the present invention to provide a process for producing such a tool which can finish workpieces to similar tolerances achieved for bore finishing.

The tool generally is comprised of an outer shell and an inner annular abrasive layer. The outer shell is metallic and has an outside surface and an inside surface. The inner abrasive layer, preferably a superabrasive, is disposed within the outer shell on an epoxy material. The inner abrasive layer defines a cavity having at least one open end for receiving the workpiece to be finished.

The inner layer is formed by first electroforming superabrasive particles around a generally cylindrical rod which has a geometry equal to the desired geometry of the tool, i.e., the desired cutting size of the tool. The coated cylindrical rod is then secured within a metallic shell by an epoxy material. The cylindrical rod is then removed from within the shell, exposing the inner annular abrasive layer secured within the shell.

Because the inner layer of the tool is an integral abrasive layer, the tool produced is capable of cutting simultaneously around a full periphery of a cylindrical workpiece. In the preferred use of the tool, a cylindrical workpiece, rotated by a spindle, passes through the tool where the outside diameter of the workpiece is finished to the appropriate size. Because the tool size is set at the initial stage of the manufacturing process using fixed abrasives, and not changed except to compensate for wear, maximum control of the cutting size of the tool is achieved. The main advantage of this feature is the consistency of the finished workpieces which can now achieve tolerances similar to the tolerances attained for bore finishing.

It is another object of the present invention to provide an outside diameter finishing tool having an adjustable cutting size which can be compensated for wear. The cutting size is determined by the diameter defined by the inner abrasive layer. After the tool finishes a great number of workpieces, the inner abrasive layer wears down and increases the cutting size of the tool. Therefore, it is desirable to be able to adjust the inner diameter of the tool to maintain the original cutting size. To accomplish this end, both the outer shell and inner layer have a longitudinal slot therethrough, which are aligned to define a slot through the entire tool. This slot allows for the tool to expand and contract, thus radially adjusting the inner layer, i.e., its cutting size.

In adjusting the cutting size of the tool, the tool is carried by a holder which has means for adjusting the inner layer of the tool. In one embodiment, the outside surface of the tool is machined frustaconical. The tool is then placed in a holding pot, which has a frustaconical inner surface matching the frustaconical outer surface of the tool, where the two surfaces are in sliding engagement with one another. The tool is forced further into the holding pot, where the mating frustaconical surfaces causes the tool to contract, thus adjusting the cutting size of the tool. In another embodiment, a cylindrical tool is carried by a standard lap holder which has a size-adjusting screw. Turning the size-adjusting screw causes the lap holder and tool to contract, thus adjusting the cutting size of the tool.

DETAILED DESCRIPTION OF THE INVENTION

Figure 1:
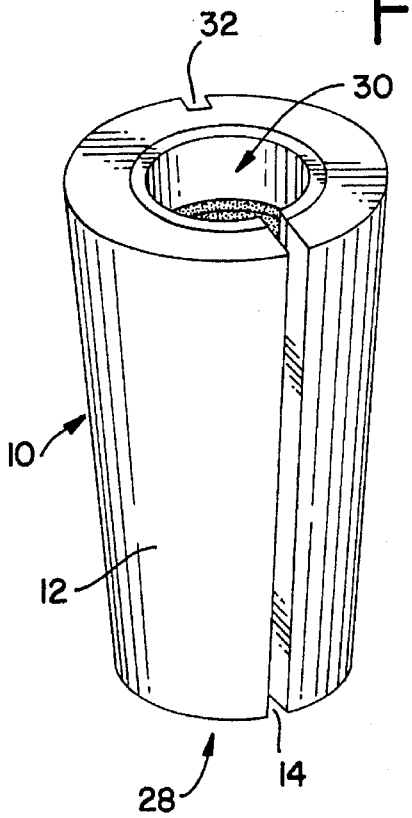
FIG. 1 is a perspective view of the preferred embodiment of the outside diameter finishing tool of the present invention.

While this invention is susceptible of embodiments in many different forms, there is shown in the drawings and will herein be described in detail, a preferred embodiment of the invention with the understanding that the present disclosure is to be considered as an exemplification of the principles of the invention and is not intended to limit the broad aspects of the invention to the embodiment illustrated.

Figure 3:
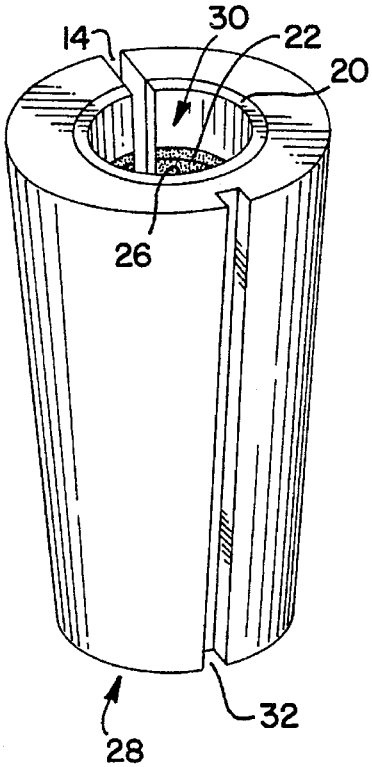
FIG. 3 is another perspective view disclosing a notch in the tool for receiving a key.
Figure 2:
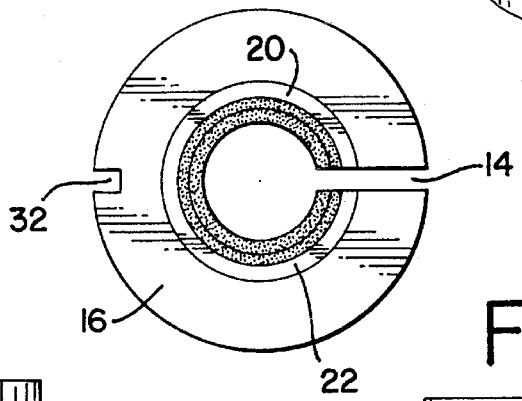
FIG. 2 is a plan view of the tool disclosing the outer shell inner annular abrasive layer of the tool.

Now referring to the drawings, FIG. 1 shows a preferred embodiment of the outside diameter finishing tool 10 of the present invention. The tool is generally cylindrical and has a gradually tapered or frustaconical outer surface 12. A longitudinal slot 14 is provided through the tool 10 to allow for expansion and contraction of the tool 10 to be described in more detail. FIG. 2 is a top view of the tool 10 illustrating the different sections of the tool. The tool 10 has an outer shell 16 which is metallic. The tool also has an inner layer 22 made of abrasives, preferably superabrasives, which perform the work on a workpiece. A substrate material 20, preferably epoxy, secures the inner abrasive layer 22 within the shell 16. The inner layer 22 defines a cavity 26 which has openings 28,30 at each end of the tool 10 as shown in FIG. 1, where a workpiece can be inserted to be finished. FIG. 3 is another perspective view which shows a notch 32 cut in the tool 10 to receive a key (not shown) which holds the tool 10 stationary while a workpiece is being finished. This feature will be described in more detail.

Figure 4:
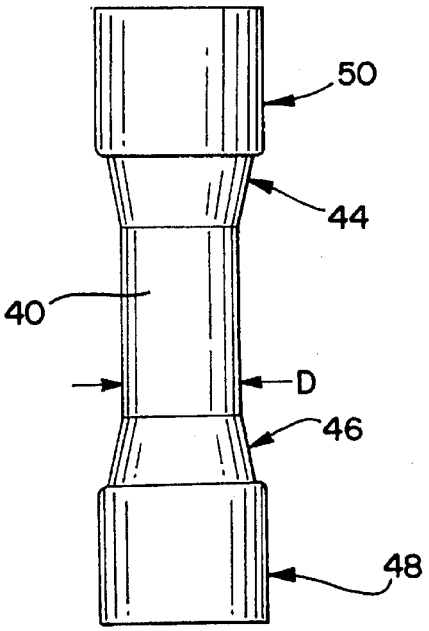
FIGS. 4–9 disclose the process for making the outside diameter finishing tool of the present invention.
Figure 5:
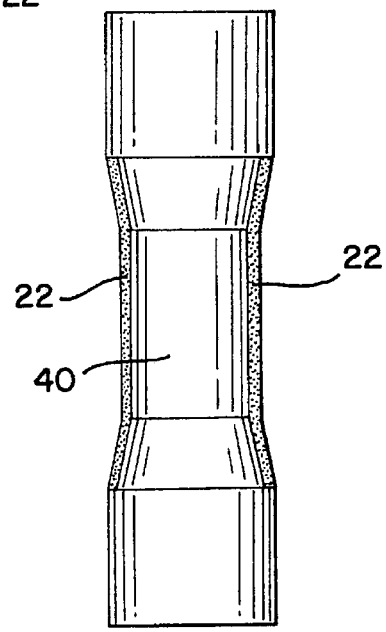

The outside diameter finishing tool 10 is produced by a unique process illustrated in FIGS. 4–9, which are cross-sectional views. First, a cylindrical rod 40 is provided, as shown in FIG. 4, which has a geometry equal to the desired geometry of the tool. In other words, the rod 40 will have a mirror shape to the tool 10, thus the diameter of the rod 40 will define the actual cutting size of the tool 10. The rod 40 is preferably made of easily machinable conductive material. Abrasive particles, preferably superabrasive particles, are then disposed about the cylindrical rod forming a superabrasive layer 22 as seen in FIG. 5. Preferably, an electroforming process is used to deposit the abrasive particles onto the rod. Other processes could also be used, however, such as sintering or metal-bonding. Although FIG. 5 is a cross-sectional view, it is understood that the abrasive particles are electroformed around the full periphery of the rod 40.

In its preferred form, the tool utilizes superabrasives such as diamond particles, which can have different grit sizes. It will be understood by those skilled in the art that material removal and surface finish are directly related to the grit size of the superabrasive particles used. Tools utilizing lower, or coarse grit superabrasives, can remove a great amount of material but with a lower surface finish. Tools utilizing higher, or fine grit superabrasives, remove less material but produce a much finer finish. Tools having different finish capabilities are needed for the variety of workpieces requiring outside diameter finishing.

Figure 6:
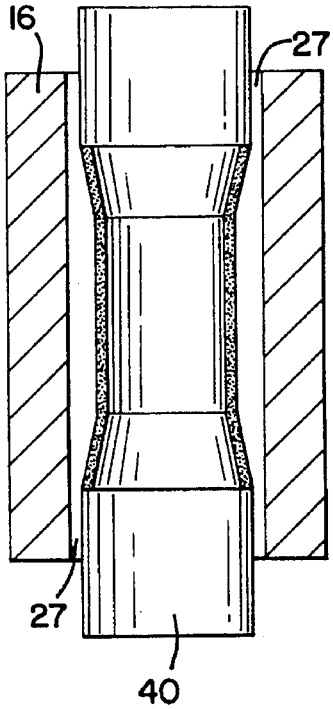
Figure 7:
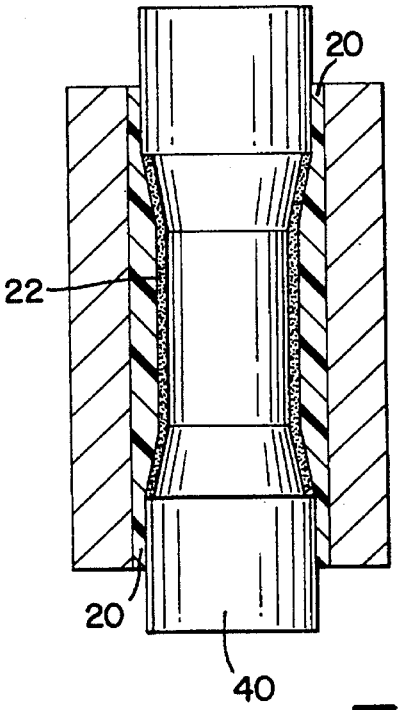

After the superabrasive layer 22 is electroformed onto the cylindrical rod 40, the rod 40 is placed into a metallic shell 16 which circumferentially surrounds the rod 40, shown in FIG. 6. The shell 16 is preferably made of cast iron, although it will be clear to those skilled in the art that other similar materials could be used. The shell 16 forms the outer portion of the tool 10. An annular space 27 is maintained between the inner surface of the shell 16 and the superabrasive coated cylindrical rod 40. As seen in FIG. 7, this space is then filled with a substrate material 20. The substrate material is preferably epoxy, although it is understood that similar materials can also be utilized to carry the inner abrasive layer 22 within the shell 16. Upon curing, the epoxy 20 secures the superabrasive coated cylindrical rod 40 within the shell 20. This forms a composite structure consisting of the shell 16, epoxy 20, inner abrasive layer 22, and the cylindrical rod 40 as shown in FIG. 7.

Figure 8:
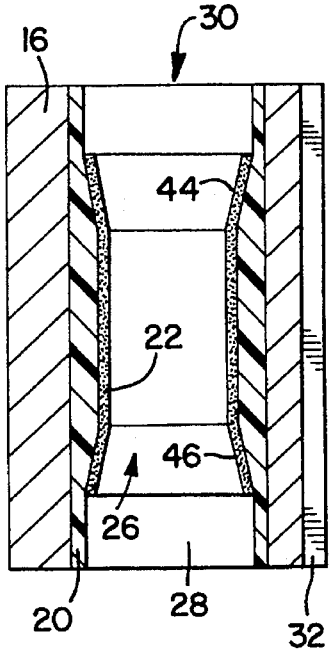

Next, the cylindrical rod 40 is removed from the composite structure which exposes an inner annular abrasive layer 22. In the preferred process, the cylindrical rod 40 is removed from the composite structure by immersing the structure into a caustic solution which dissolves the rod 40 while leaving the remainder of the structure intact. The cylindrical rod 40 can also be removed by grinding the cylindrical rod 40 to expose the superabrasive inner layer 22. As seen in FIG. 8, the newly exposed inner annular abrasive layer 22 defines a cavity 26 once occupied by the cylindrical rod. There is an opening 28,30 at each end of the cavity 26, one of which can receive a workpiece to be finished.

As seen in FIG. 4, the initial cylindrical rod 40 has a central cylindrical portion 42 which defines the cutting size "D" of the tool. The rod 40 also has outwardly tapered intermediate sections 44,46 with larger diameter end sections 48,50. As seen in FIGS. 7–8, when the cylindrical rod 40 is removed from the tool 10, the inner surface of the tool mirrors the shape of the cylindrical rod 40 and, thus, the inner surface of the tool 10 has outwardly tapered sections 44,46 as well. The tapered sections 44,46 of the tool 10 allow the tool to smoothly engage a workpiece as the workpiece enters the cavity 26 defining the desired cutting size D of the tool 10. Although the preferred embodiment of the invention utilizes the rod 40 as illustrated in FIG. 4, it is understood that cylindrical rods having other configurations can also be used as the initial cylindrical rod 40.

The inner annular abrasive layer 22 can now receive a cylindrical workpiece to be finished. Normally, the workpiece (not shown), such as a piston rod, is connected to a spindle which rotates the workpiece and linearly inserts the workpiece into the opening 30 of the tool 10. As the workpiece enters the tool 10, an initial amount of material is removed from the workpiece by the superabrasives defining the outwardly tapered section 44. When the workpiece is fully within the tool 10, additional material is gradually removed around the full periphery of the workpiece by the inner abrasive layer 22 of the tool. The workpiece is then retracted having a finished outside diameter. The spindle may or may not be allowed to float by means of a floating holder well known in the art. The floating holder assists in properly aligning the spindle and, therefore, the workpiece with the tool. In a slightly different finishing process, the workpiece may be held stationary while the tool is rotated by a spindle and passed over the workpiece to finish the outside diameter.

Since the inner abrasive layer 22 of the tool, which defines the cutting size D, is initially set by the original cylindrical rod 40, many advantages are attained through the use of the tool 10. The tolerances achieved by the tool 10 are greatly enhanced because the cutting size D is automatically set prior to the manufacturing cycle. The size is set when selecting the initial cylindrical rod 40 having the desired diameter to electroform superabrasives thereon. There is no manual sizing or adjustment necessary as with some of the prior art methods. This initial automatic sizing also improves the consistency of the tool 10 as it can finish many workpieces to identical tolerances. The use of fixed, rather than loose, abrasives also improves the tolerances achieved by the tool 10. The tool life is also improved due to the long wear characteristics of superabrasives. Initial results show that consistent finishing to below 0.000030" is possible. In addition, because the tool 10 cuts simultaneously around the full periphery of the workpiece, very little heat and stress are generated, which enables increased control over the workpiece finish.

Over time, the superabrasive inner layer 22 of the tool 10 wears down after finishing a number of workpieces, thus increasing the cutting size D defined by the inner abrasive layer 22. The workpieces are subsequently not finished to the desired diameter and would have to be finished by an additional tool having the appropriate cutting size D. To avoid the need for an additional tool, it is desirable to provide an outside diameter finishing tool 10 which has an adjustable cutting size D. The cutting size D is made adjustable by radially adjusting the inner abrasive layer 22 of the tool 10. Radial adjustment is made possible by providing a longitudinal slot 14 through the entire tool as shown in FIGS. 1 and 2. The slot 14 is machined into the tool. This allows the tool to expand and contract, thus radially adjusting the inner abrasive layer 22 of the tool 10.

Figure 9:
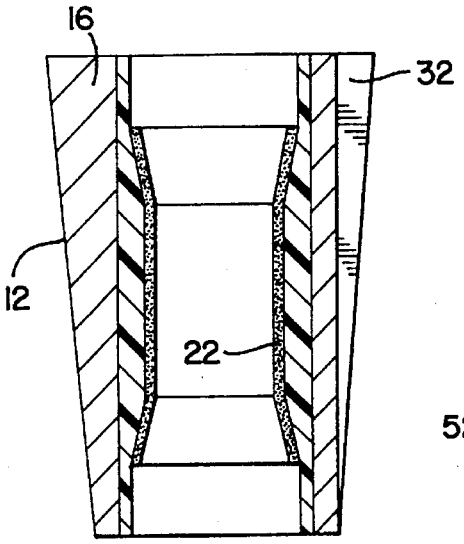
Figure 10:
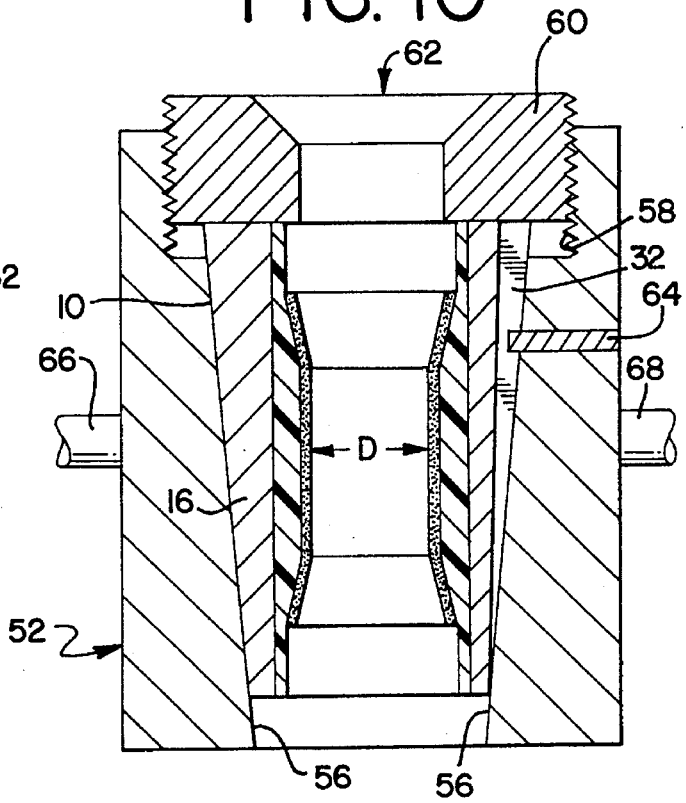
FIG. 10 discloses the tool in a holding pot for radially adjusting the cutting size of the tool.

To facilitate this radial adjustment, the outer surface 12 of the outer shell 16 of the tool 10 is machined frustaconical as shown in FIG. 9. The tool 10 is then placed into a holding pot 52 as shown in FIG. 10. The holding pot 52 has an opening 54 which is deep enough to completely surround the tool 10. The inner surface 56 of the holding pot 52, defining the opening 54 is frustaconical and matches the frustaconical outer surface 12 of the tool 10. The tool 10 and holding pot 52 are then in sliding engagement with one another. At the top of the holding pot, a threaded inner portion 58 receives a screwed fitting 60. The screwed fitting 60 contacts one end of the tool 10 and when turned, forces the tool 10 further into the holding pot 52 in the direction shown by the arrow. This movement causes the tool to contract, allowed by the slot 14 through the tool 10, and the diameter defined by the inner abrasive layer 22 is decreased to the original cutting size D. This process allows the tool 10 to maintain its desired cutting size D even after the inner abrasive layer 22 wears down. The screwed fitting 60 has an opening 62 to allow the workpiece to pass through the fitting 60 and into the tool 10.

FIG. 10 also shows a key 64 positioned in the holding pot. This key is dimensioned to fit into the notch 32 located at the outside surface of the tool seen in FIG. 2. When the key 64 is inserted into the notch 32 of the tool 10, any tool rotation is prevented as a workpiece rotates within the tool. This assures a more efficient finishing process.

Figure 14:
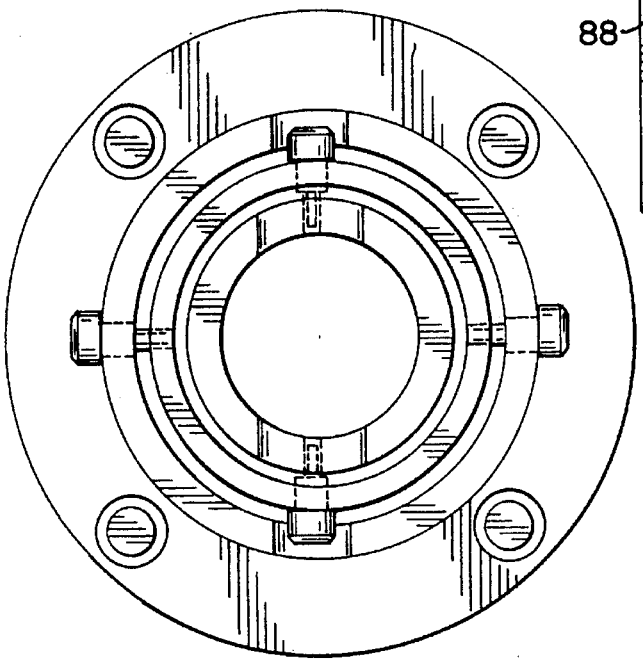

FIG. 10 also shows posts 66,68 located on the outer surface of the holding pot 52 which can be used for connection to a base to hold the holding pot 52 and tool stationary during the finishing process. These posts could also connect to a gimbal fixture, as disclosed in U.S. application Ser. No. 08/123,608 filed on Sep. 17, 1993 and FIG. 14. The gimbal fixture allows for pivotal and lateral sliding movement of the holding pot 52 to facilitate more precise alignment between the tool 10 and workpiece during the finishing process. With the use of a gimbal fixture, a more substantially uniform pressure is believed to be developed between the confronting surfaces of the workpiece and tool during the finishing process. Use of a gimbal fixture would, therefore, further increase the efficiency of the finishing process.

Figure 11:
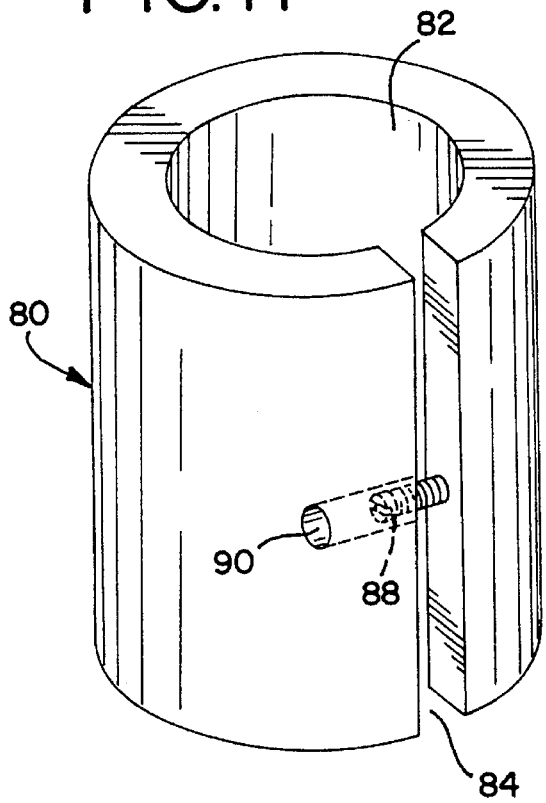
FIG. 11 discloses a standard lap holder which holds the tool and utilizes another method of radially adjusting the cutting size of the tool.
Figure 12:
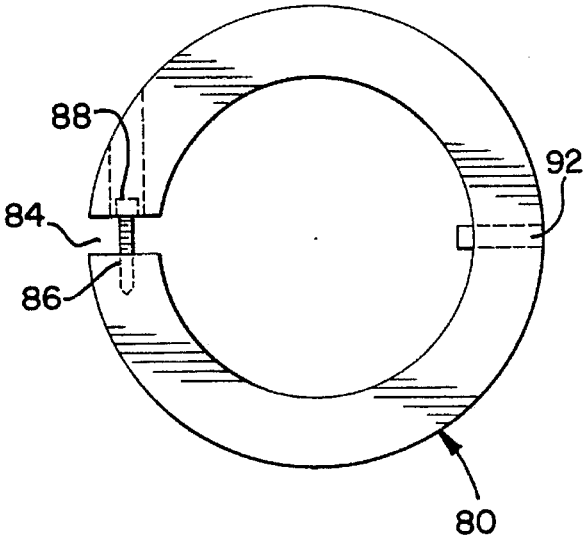
FIG. 12 discloses a top view of the standard lap holder.
Figure 13:
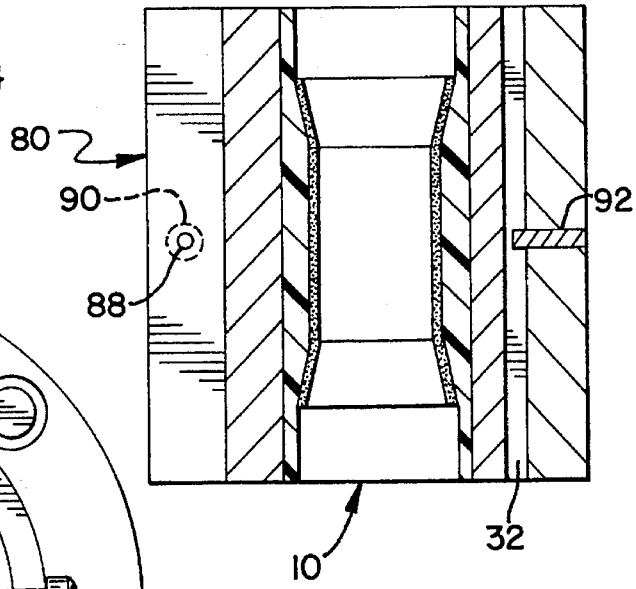
FIG. 13 discloses a cross-sectional view of the tool held by the standard lap holder; and, FIG. 14 discloses a top view of a gimbal.

Another method to radially adjust the cutting size of the tool is disclosed in FIGS. 11–13. FIG. 11 discloses a standard lap holder 80. The standard lap holder is cylindrical and dimensioned to receive a cylindrical tool 10 (FIG. 8) through an opening 82 (FIG. 11). The standard lap holder 80 has a slot 84 to allow contraction of the lap holder 80. As seen in FIG. 12, there is a threaded channel 86 extending within the standard lap holder 80 on both sides of the slot 84. The threaded channel 86 receives a size adjusting screw 88 through an opening 90 in the outside surface of the standard lap holder 80. FIG. 12 also shows a key 92 similar to key 64 in FIG. 10. As seen in FIG. 13, the key 92 fits in slot 32 of the tool 10 to prevent the tool 10 from rotating within the standard lap holder 80 when a workpiece is being finished.

As seen in FIG. 13, the standard lap holder 80 is cylindrical and receives a tool having a corresponding cylindrical outer surface, such as the tool 10 shown in FIG. 8. When the cutting size of the tool requires adjustment for wear, size adjusting screw 88 is turned to contract the standard lap holder 80. This contraction will thus contract the inner abrasive layer 22 of the tool 10 to radially adjust the cutting size of the tool 10. The standard lap holder 80 could also be connected to a gimbal fixture as previously described to increase the efficiency of the finishing process.

It is also contemplated that a plurality of outside diameter finishing tools of gradually decreasing cutting size can be used to finish cylindrical workpieces to a desired diameter. The workpieces to be finished are indexed on a precision surface finishing machine substantially similar to the one disclosed in U.S. application Ser. No. 08/123,608.

While the invention has been described with reference to a preferred embodiment of the invention, it will be understood by those skilled in the art that various modification may be made and equivalents may be substituted for elements thereof without departing from the broader aspects of the invention. The present examples and embodiments, therefore, are illustrative and should not be limited to such details.

We claim:

1. A precision surface finishing tool for uniform micron-tolerance polishing of an outer diameter of a workpiece comprising:

an outer shell having an outside surface and an inside surface; and, an inner annular superabrasive layer carried on the inside surface on an adhesive resin layer forming a cavity having an outwardly tapered section and a cylindrical section where one end of the outwardly tapered section is in communication with the cylindrical section, the outwardly tapered section having another end defining an opening in the tool, to receive a workpiece to be finished.

2. The device of claim 1 wherein the outer shell has a longitudinal slot through the shell.

3. The device of claim 2 wherein the inner layer has a longitudinal slot aligned with the longitudinal slot of the shell to allow for expansion and contraction of the tool to radial adjust the inner layer of the tool.

4. The device of claim 3 wherein the tool is carried by a holder.

5. The device of claim 4 wherein the holder has means for radially adjusting the inner layer of the tool.

6. The device of claim 5 wherein the outside surface of the outer shell is frustaconical.

7. The device of claim 6 wherein the holder is a holding pot.

8. The device of claim 7 wherein the holding pot has a frustaconical inner surface dimensioned to receive the tool where the frustaconical inner surface of the holding pot and the frustaconical outside surface of the shell are in sliding engagement with one another.

9. The device of claim 8 wherein the ouster shell has a notch for receiving a key to maintain the tool stationary as the workpiece is finished.

10. The device of claim 9 wherein the holding pot there is provided a key, dimensioned to be inserted into the notch, to prevent the tool from rotating as the workpiece is finished.

11. The device of claim 10 further comprising a fitting received by the frustaconical inner surface of the holding pot and contacting one end of the tool to force the frustaconical outside surface of the shell along the frustaconical inner surface of the holding pot to radially adjust the inner layer of the tool.

12. The device of claim 11 wherein the holding pot is held by aligning means adapted to guide the tool and workpiece into more precise alignment with one another.

13. The device of claim 12 wherein the aligning means is a gimbal that permits pivotal and sliding movement of the holding pot with respect to the workpiece.

14. The device of claim 5 wherein the outside surface of the outer shell is cylindrical.

15. The device of claim 14 wherein the holder is a standard lap holder.

16. The device of claim 15 wherein the lap holder has a cylindrical opening dimensioned to receive the tool.

17. The device of claim 16 wherein the lap holder has a longitudinal slot to allow for radial adjustment of the lap holder.

18. The device of claim 17 wherein the lap holder there is provided a size adjusting screw which decreases the slot in the lap holder to radially adjust the inner layer of the tool.

19. The device of claim 18 wherein the outer shell has a notch for receiving a key to maintain the tool stationary as the workpiece is finished.

20. The device of claim 19 wherein the lap holder there is provided a key, dimensioned to be inserted into the notch to prevent the tool from rotating as the workpiece is finished.

21. The device of claim 20 wherein the lap holder is held by aligning means adapted to guide the tool into more precise alignment with the workpiece.

22. The device of claim 21 wherein the aligning means is a gimbal that permits pivotal and sliding movement of the tool with respect to the workpiece.

* * * * *

UNITED STATES PATENT AND TRADEMARK OFFICE

CERTIFICATE OF CORRECTION

PATENT NO. : 5,564,972

DATED : October 15, 1996

INVENTOR(S) : Robert Marvin, Malcolm Owen and Donald Bouchard

It is certified that error appears in the above-indentified patent and that said Letters Patent is hereby corrected as shown below:

Column 8, line 8, the word appearing as "ouster" should be -- outer --

Signed and Sealed this

Twenty-fifth Day of March, 1997

*Attest:*

*Attesting Officer*

BRUCE LEHMAN

*Commissioner of Patents and Trademarks*